US005229685A

United States Patent [19]

Kim et al.

[11] Patent Number: 5,229,685

[45] Date of Patent: Jul. 20, 1993

[54] PLASMA DISPLAY PANEL

[75] Inventors: Dae-il Kim, Kyunggi; Seung-woo Lee, Seoul; Yong-ho Gweon, Pusan, all of Rep. of Korea

[73] Assignee: Samsung Electron Devices Co., Ltd., Kyunggi, Rep. of Korea

[21] Appl. No.: 724,216

[22] Filed: Jul. 1, 1991

[30] Foreign Application Priority Data

Jul. 3, 1990 [KR] Rep. of Korea ..... 90-10033
Jul. 4, 1990 [KR] Rep. of Korea ..... 90-10096

[51] Int. Cl.[5] ..... H01J 17/49
[52] U.S. Cl. ..... 313/484; 313/584
[58] Field of Search ..... 313/484, 582, 584, 585, 313/590; 315/169.3; 445/24, 25

[56] References Cited

U.S. PATENT DOCUMENTS 4,423,352 12/1983 Miyazaki ..... 313/584
4,516,053 5/1985 Amano ..... 313/584
5,004,950 4/1991 Lee ..... 313/582

*Primary Examiner*—Donald J. Yusko
*Assistant Examiner*—Michael Horabik
*Attorney, Agent, or Firm*—Leydig, Voit & Mayer

[57] ABSTRACT

A DC type plasma display panel wherein a plurality of barriers of a predetermined height are formed parallel to each other within the interval of a predetermined space between the front and rear substrate having one anode embedded in the middle of each barrier and cathodes are arranged on the inner surface of the rear substrate crossing the anodes at right angles avoiding the loss of discharged light due to anode abstraction and realizing higher screen luminance.

3 Claims, 4 Drawing Sheets

PLASMA DISPLAY PANEL

FIELD OF THE INVENTION

This invention relates to a plasma display panel and more particularly to a DC type plasma display panel of improved structure wherein discharge light effectively works for image display.

BACKGROUND OF THE INVENTION

The basic structure of a conventional DC type plasma display panel is illustrated in FIG. 1.

A plurality of barriers 30 of a certain height are arranged parallel to each other at a predetermined interval between the rear substrate 20 and front substrate 10.

A group of transparent anodes 40 parallel to the barriers 30 are formed on the inner surface of the front substrate 10 between barriers 30 while a plurality of cathodes 50 are arranged in stripes on the inner surface of the rear substrate 20 and crossing the anodes 40 at right-angles thereto.

In the conventional plasma display panel, discharge light produced within the intervals between transparent anodes 40 and the cathodes 50, is viewed at the front substrate 10 and through transparent anodes 40. Subsequently, much of the discharge light is absorbed by the transparent anodes 40, degrading the luminance of the viewed picture. In addition, the conventional plasma display panel does not have constant luminance throughout the screen because the anodes 40 are made of a highly resistive material, for example, indium tin oxide.

In order to alleviate the foregoing shortcomings, a plasma display panel as illustrated in FIGS. 2 and 3 has been introduced. This plasma display panel was designed to directly pass the discharged light produced in the space between the anodes and the cathodes to the front substrate without interference from the anodes. To accomplish this, the plasma display panel has a plurality of barriers 30' of a predetermined height arranged as parallel stripes and used as spacers to maintain a predetermined distance between a front substrate 10 and rear substrate 20, while anodes 40', parallel to barriers 30', are embedded in one flank of every barrier 30' on the inner surface of the front substrate 10. A plurality of striped cathodes 50 are formed on the inner surface of the rear substrate 20 crossing the anodes 40' at right angles thereto.

The plasma display panel with the above structure is characterized in that only a portion of each anode 40' is embedded in the flanks of the barriers.

In the structure of the above plasma display panel the placement of anodes is different from FIG. 1 so that the discharge light produced in the space between anodes 40' and cathodes 50 does not pass through the anodes 40'. Therefore, unlike the prior art plasma display panels, the anode 40' can be made of a more conductive material, for example, metallic paste.

This plasma display panel, however, still has an inevitable shortcoming whereby discharge light is partially cut-off by the portion of anodes 40' projecting from the barriers 30'. Moreover, directive luminance that is the luminance of discharged light as viewed from the front, alters its subject according to the direction of the viewer, for example as in FIG. 3, direction a or direction b.

SUMMARY OF THE INVENTION

It is an object of the present invention to provide a plasma display panel having constant luminance. This and other objects can be realized by a front and rear substrate having a predetermined distance between each other, a plurality of parallel barriers formed between the front and rear substrates, a plurality of anodes arranged as stripes and embedded in one side of the middle of each barrier and off the inner surfaces of both front and rear substrates and a plurality of cathodes arranged as stripes on the inner surface of the rear substrate and crossing the anodes at right-angles thereto.

In one embodiment of the present invention, an anode is embedded in the middle of individual barriers as an independent unit layer, with only its edge surface exposed to the discharging space. Another embodiment of this invention removes a portion of the barrier adjacent to the inner surface of the front substrate to form a longitudinal cutaway portion of predetermined depth along the barrier and open to the discharging space so that the anode can be located on the bottom of the cutaway portion, opposite the inner surface of the front substrate. As the result, the whole surface of one side of the anode is exposed to a discharging space.

DESCRIPTION OF THE PREFERRED EMBODIMENTS

Figure 1:
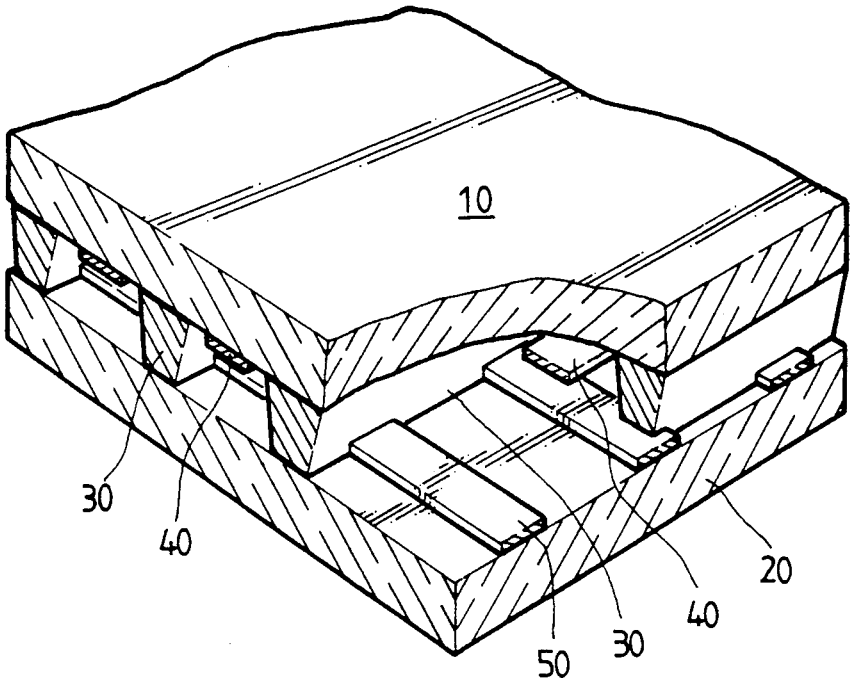
FIG. 1 (PRIOR ART)
FIG. 1 is a fragmentary and cutaway perspective of a conventional plasma display panel.
Figure 2:
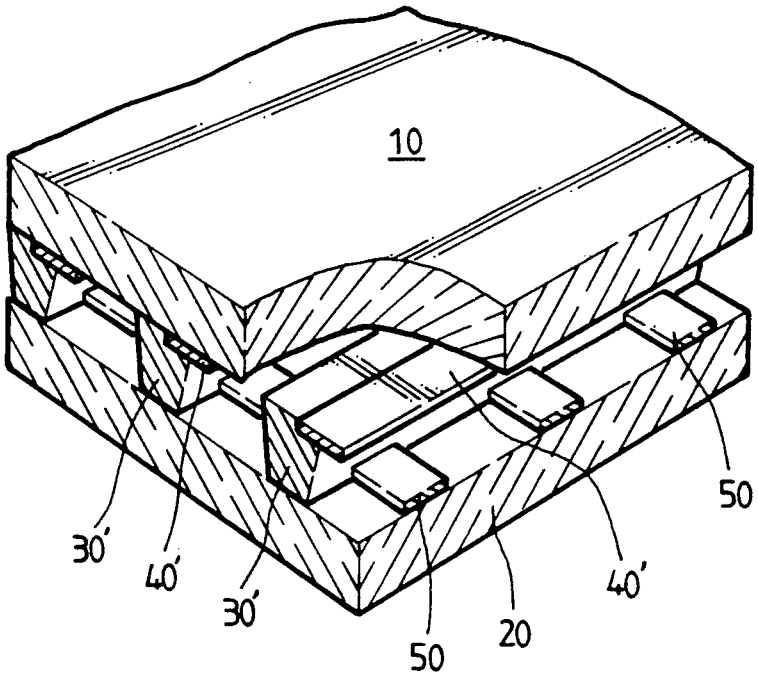
FIG. 2 (PRIOR ART)
FIG. 2 is a fragmentary and cutaway perspective of another conventional plasma display panel.
Figure 3:
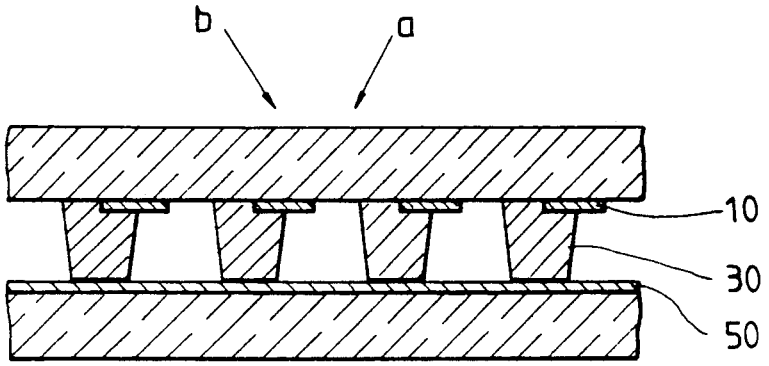
FIG. 3 (PRIOR ART)
FIG. 3 is a sectional view of the conventional plasma display panel shown in FIG. 2.
Figure 4:
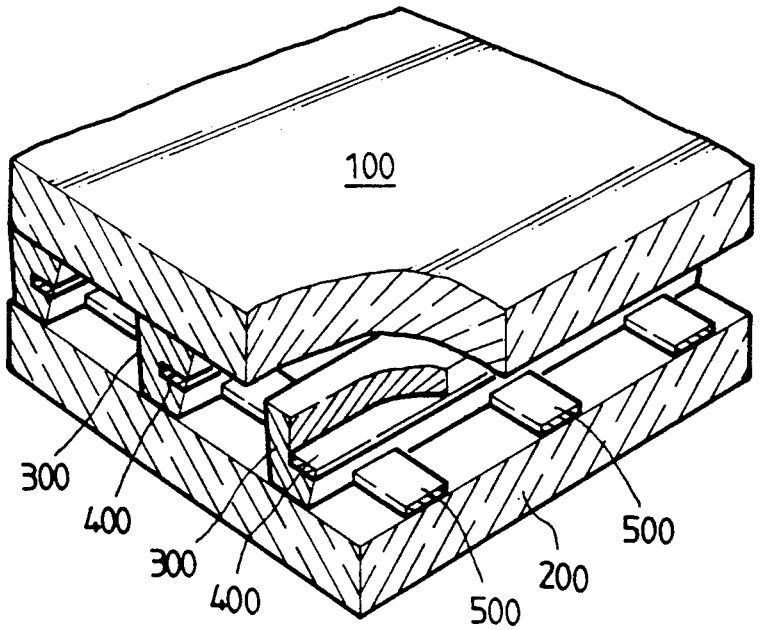
FIG. 4 is a fragmentary and cutaway perspective of an embodiment of a plasma display panel according to the present invention.
Figure 5:
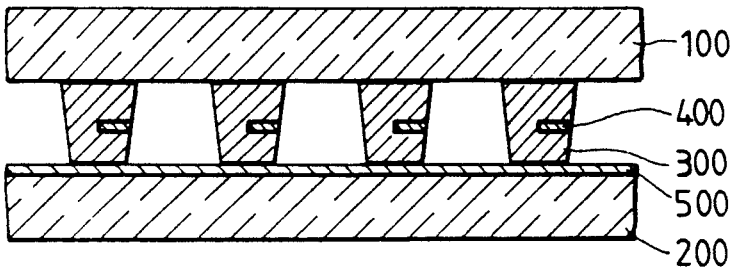
FIG. 5 is a sectional view of the plasma display panel shown in FIG. 4.

As shown in FIGS. 4 and 5, a plasma display panel of the present invention comprises components common to general plasma display panels.

A plurality of barriers 300 of a predetermined height are formed parallel to each other functioning as spacers between the front and rear substrates 100 and 200 which are placed at a predetermined distance from each other. An anode 400, in parallel with other anodes is embedded along one side of the middle of each barrier 300, with only its edge surface exposed to the discharging space. A group of cathodes 500 arranged as stripes are formed on the inner surface of the rear substrate 200, crossing anodes 400 at right-angles thereto.

The anode 400 embedded in the middle of each barrier 300 is formed during the course of forming the barrier 300 by a screen printing method. For the first step, a roughly processed barrier is formed by accumulating a plurality of unit layers on the inner surface of the front substrate 100 via a screen printing method. After which an anode 400 of conductive nickel paste is formed on the roughly processed isolating rib. Here, the anode 400 is flush with or somewhat projected from one flank of the roughly processed barrier. Thereafter, isolating rib 300 is completed by successively accumulating a plurality of unit layers over the anode 400.

A group of cathodes 500 on the rear substrate 200 are formed, also of conductive nickel paste, by a screen printing method (which is also used for barriers 300 and anodes 400).

A plasma display panel according to this invention is characterized in that the anode 400 which provides gas charge interacting with the cathode 500, is segregated from the front substrate 100 at a predetermined distance by being placed in the middle of each barrier 300 which are installed to avoid crosstalk. Accordingly, all the discharged light produced in the space between the anode 400 and the cathode 500 can be projected between the barrier and through the light-transmitting area of the front substrate 100 because the discharge light is emitted without anode interference, unlike conventional plasma display panels.

As the result, no loss of light occurs due a anodes and image luminance viewed from the front of front substrate 100 improves. Of particular note is the uniform luminance, regardless of from where the display panel is viewed.

Figure 6:
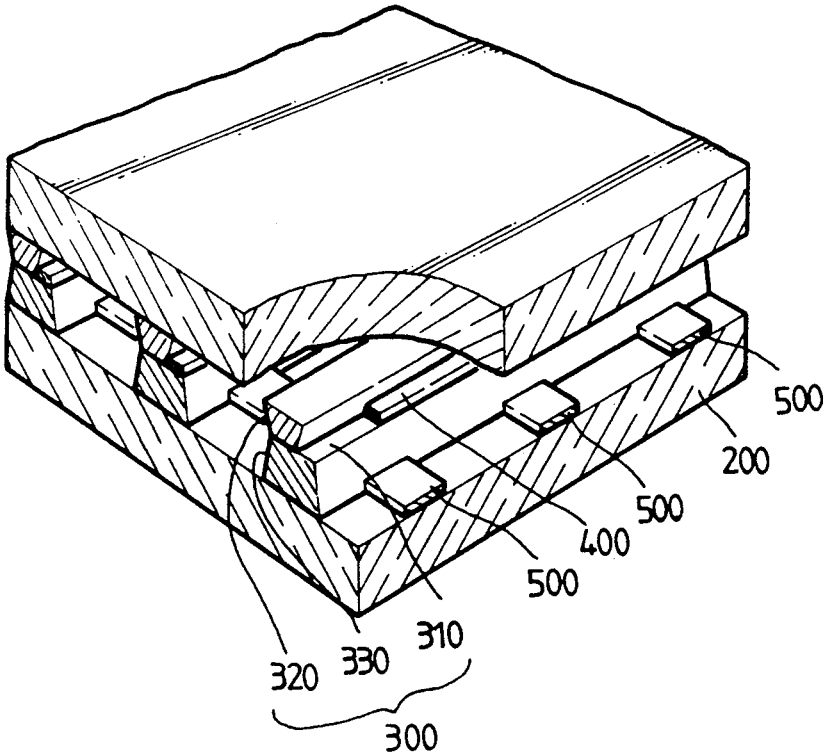
FIG. 6 is a fragmentary and cutaway perspective of another embodiment of a plasma display panel according to the present invention.
Figure 7:
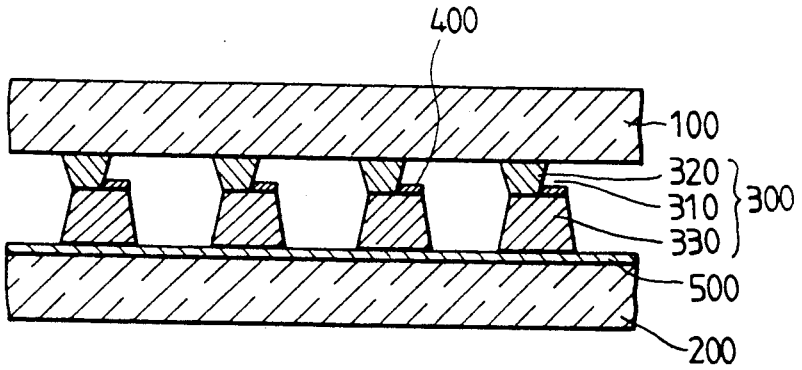
FIG. 7 is a sectional view of the plasma display panel shown in FIG. 6.

Another type of plasma display panel is illustrated in FIGS. 6 and 7. This type of plasma display has the same basic structure as the aforementioned plasma display panel.

That is, a plurality of isolating ribs 300 of a predetermined height are formed parallel to each other functioning as spacers between the front and rear substrates 100 and 200 which are placed at a predetermined distance from each other.

An anode 400, in parallel with other anodes, is embedded along one side of the middle of each barrier 300 while a group of cathodes 500 arranged as stripes are formed on the inner surface of the rear substrate 200, crossing anodes 400 at right-angles thereto.

In a plasma display panel of this type, an anode 400 is located on the bottom wall of the groove 310 to be conformed to the body of the barrier 300. Therefore, the anode 400 faces the inner surface of the front surface 100 from a predetermined distance exposing the whole surface of one side of the anode 400 to the discharging space.

The groove 310 is formed by walls provided by a first barrier 320 which is the upper part of the barrier 300 and a second isolating rib 330, the lower part.

The first barrier 320 is arranged on the inner surface of the front substrate 100, being narrower and shorter than the second barrier 330, aligns one flank to that of the second isolating rib 330.

The firs and the second barriers 320 and 330 are respectively formed on the front substrate 100 and the rear substrate 200 by multiple screen printing method, and the anode 400 on the second barrier 330, conforming to the bottom wall of the groove 310, is also formed by a screen printing method.

Since this plasma display panel has the whole surface of one side of the anode 400 exposed to the discharging space, discharges more powerful than the prior embodiment, are possible while having all the general functions of the prior one.

As described above, the plasma display panel according to the present invention is directed to make the most of the discharged light in the most effective way and is also applicable to other embodiments different from the aforesaid embodiments. It will be apparent that plasma display panels having anode separated from a front substrate in the middle of the isolating rib between an front and rear substrate for better transmission of discharged light are within the spirit and scope of this invention.

What is claimed is:

1. A plasma display panel comprising:

a front and rear substrate separated by a predetermined distance;

a plurality of barriers arranged parallel to each other in a direction between the front and rear substrate;

a plurality of anodes, each of which is placed within said barriers; and a plurality of cathodes arranged on the inner surface of the rear substrate and at right angles to said anodes.

2. A plasma display panel as claimed in claim 1, wherein each of said anodes is embedded in the middle of said barrier as an independent unit layer, having only one surface exposed to the discharging space.

3. A plasma display panel comprising:

a front substrate having inner and outer surfaces;

a rear plate having inner and outer surfaces, the inner surface opposing the inner surface of said front substrate;

a plurality of anodes having upper and lower surfaces and first and second edges, each of said anodes disposed within one of said plurality of barriers such that the upper and lower surfaces are covered by said barriers and only one of the first and second edges is exposed;

a plurality of cathodes arranged on the inner surface of the rear substrate and at right angles to said anodes.

* * * * *